US005333666A

United States Patent [19]

Ootomo et al.

[11] Patent Number: 5,333,666

[45] Date of Patent: Aug. 2, 1994

[54] METHOD FOR MANUFACTURING A RESIN PATTERN, AND A METHOD FOR VACUUM SEALED MOLDING PROCESS USING RESIN PATTERN SAME

[75] Inventors: Hideo Ootomo; Hiroshi Takeda; Shunichiro Yachi, all of Hitachi, Japan

[73] Assignee: Hitachi, Ltd., Tokyo, Japan

[21] Appl. No.: 968,410

[22] Filed: Oct. 29, 1992

[30] Foreign Application Priority Data

Oct. 29, 1991 [JP] Japan ..... 3-282673

[51] Int. Cl.[5] ..... B22C 7/00

[52] U.S. Cl. ..... 164/45; 164/7.2; 164/37

[58] Field of Search ..... 164/7.1, 7.2, 13, 37, 164/45, 61

[56] References Cited

U.S. PATENT DOCUMENTS

| | | | |
|---|---|---|---|
| 984,461 | 2/1911 | Bayer | 164/45 |
| 3,065,511 | 11/1962 | Leitzel | 164/45 |
| 4,726,412 | 2/1988 | Magnan | 164/45 |

FOREIGN PATENT DOCUMENTS

| | | | |
|---|---|---|---|
| 49-11535 | 3/1974 | Japan | 164/45 |
| 54-107428 | 8/1979 | Japan | 164/7.2 |
| 58-205642 | 11/1983 | Japan | 164/45 |
| 59-27750 | 2/1984 | Japan | 164/7.2 |
| 63-174756 | 7/1988 | Japan | 164/7.2 |

OTHER PUBLICATIONS

Plastic Pattern Equipment, Steve Denkinger, Jr. Atlas Pattern Plastic Works, Jun. 1948.

*Primary Examiner*—P. Austin Bradley
*Assistant Examiner*—Rex E. Pelto
*Attorney, Agent, or Firm*—Antonelli, Terry, Stout & Kraus

[57] ABSTRACT

A method for manufacturing a resin pattern, which does not break films in a vacuum sealed molding process and does not have secular deterioration even after repeated usages wherein a covering film is tightly contacted to an original pattern by vacuum suction, an amount of particle bodies are packed onto the covering film in a flask under the above described condition, upper portion of the flask is covered by another covering film, the tight contact of the covering film to the original pattern is released by returning the reduced pressure to normal pressure, internal pressure of the packed particle bodies is reduced, a mold cavity is formed by removing the original pattern from the packed particle bodies, a predetermined number of double solid bodies are set up in the mold cavity in the packed particle bodies which is previously turned reversely so as to be the cavity at upper side, molding resin is poured into the mold cavity, cores in the double solid bodies are withdrawn for forming through holes after hardening the resin, and the resin pattern is obtained by returning the internal reduced pressure of the packed particle bodies to normal pressure for breaking down the packed particle bodies.

1 Claim, 16 Drawing Sheets

METHOD FOR MANUFACTURING A RESIN PATTERN, AND A METHOD FOR VACUUM SEALED MOLDING PROCESS USING RESIN PATTERN SAME

BACKGROUND OF THE INVENTION (1) Field of the Invention

The present invention relates to a method for manufacturing a resin pattern and a method for vacuum sealed molding process using the resin pattern, especially, to the method for manufacturing the resin pattern preferable for general casting, and molding using the pattern such as plastic molding and silicone rubber molding, and the method for vacuum sealed molding process using the resin pattern same.

(2) Description of the Prior Art

Conventionally, a method for vacuum sealed molding process using wooden patterns has been generally used (JP-A-49-87521 (1974)) for manufacturing, for example, of bearing brackets of traction motors for locomotives by casting.

First, a wooden pattern having same shape as an upper half or a lower half of a steel casted final product is manufactured. When manufacturing the wooden pattern, a wooden plate is cut out in a shape of the steel castings and patterns of all members are manufactured in order to form the same shape as the upper half or the lower half of the steel casted final product, and subsequently, the patterns of the members are assembled in the same shape as the upper half or the lower half of the steel casted final product. Further, necessary vents for subsequent vacuum sealed molding process are provided to the wooden patterns by drilling. A plurality of the wooden patterns having the same shape as the upper half or the lower half of the steel casting are prepared by the same method as the above described method, and the wooden patterns of the upper half and the lower half are combined together and are used for manufacturing the steel casting by the vacuum sealed molding process.

Next, the vacuum sealed molding process is explained.

First, the combined wooden pattern is fixed on a hollowed surface plate (a vacuum box) and is covered with a film, for example, a thin plastic film having a large elongation percentage and a high plastic deformation rate. The film is softened by heating, and the softened film is made to contact tightly on surface of the wooden pattern by suction through the vents in the wooden pattern with reducing pressure of the vacuum box. Subsequently, the wooden pattern tightly covered by the film is enclosed with flasks which have a means for reducing pressure, a predetermined amount of dried sand which has controlled grain sizes is filled into the flask with vibration, and surface of the dried sand which is filled in the flask is covered with same film as above described. Then, the pressure in the vacuum box is increased to atmospheric pressure so as to release the tight contact of the film on the surface of the wooden pattern, farther, the dried sand in the flask is hardened by reducing pressure in the flask through a means for reducing pressure which is furnished to the flasks, and a drag which has same fabrication plane as the wooden pattern on remained surface of the dried sand is formed by tearing off the wooden pattern from the dried sand. The drag and a cope which is formed by the same method as above described method are combined together, and molten metal is poured into an internally formed mold cavity (fabrication plane). And after the molten metal is solidified, the reduced pressure in the flask is returned to atmospheric pressure. The dried sand regains fluidity again by returning to atmospheric pressure, and casting product can be completed by recovering of the sand. Besides, the wooden pattern can be used repeatedly in the vacuum sealed molding process, and the same casting product as the above described product can be manufactured in mass production. The recovered dried sand can be used again after cooling.

However, the conventional vacuum sealed molding process had such various problems as described hereinafter because of using wooden pattern. That is, as many wooden members are integrated together to form the wooden pattern, the above described film is broken by contacting planes and grains of the wooden members when tearing off the wooden pattern from the dried sand. Farther, after repeated usage of the wooden pattern, faults in dimensions of the casting product are caused by secular deterioration (distortion by abrasion, breakage, dehydration, and humidification), and refabrication of the mold and correction of the casting product by hands become necessary. Farther, the wooden pattern used in the vacuum sealed molding process is to be drilled vents for decreasing pressure in order to contact a film tightly on surface of the wooden pattern, but conventionally, manufacturing of the vents have been performed by hands and necessitated a very long time. And, as the wooden pattern was manufactured one by one by hands, cost of the manufacturing became remarkably expensive when a large number of the wooden patterns were manufactured.

SUMMARY OF THE INVENTION (1) Objects of the Invention

The present invention has been achieved in consideration of the above described problems, and is aimed at providing a method for manufacturing a resin pattern which naturally does not break films, does not cause secular deterioration even after repeated usages, and is cheap and easily manufactured for vents, and a method for vacuum sealed molding process using the resin pattern same. Farther, another object of the present invention is to provide a method for manufacturing a resin pattern which naturally does not break films, does not cause secular deterioration even after repeated usages, and is cheap for other usage than the vacuum sealed molding process, and a method for self hardening molding process and green sand molding process using the resin pattern same.

(2) Methods Solving the Problems

One of the features, the first feature, of the present invention is a method for manufacturing a resin pattern for vacuum sealed molding process wherein one of mold planes of an original pattern is covered with a covering film, the film is contacted with the pattern by suction, a predetermined amount of particle bodies are filled onto the film in a flask surrounding the film which is in a condition of tightly contacting to the pattern, upper portion of the flask is covered with another film, subsequently, the tight contact of the film is released by returning the reduced pressure being added to the film to normal pressure, inside of the packed particle bodies is evacuated and maintained that condition, the pattern is removed from the packed particle bodies under the condition, the packed particle bodies having a mold cavity obtained by removing the pattern is turned up side down in order to make the mold cavity up side, a predetermined number of double solid bodies composed of cores and exterior covers covering the cores are set up, subsequently, a resin is poured into the mold cavity of the packed particle bodies and is hardened, through holes are formed by removing the cores of the double solid bodies, and subsequently, a mold having the same shape as the pattern is obtained by break down the packed particle bodies after returning the inside of the packed particle bodies to the normal pressure.

Farther, the first feature includes a method for vacuum sealed molding process using the resin patterns, wherein a plurality of the resin patterns manufactured by the previously described method are placed on a vacuum box, surfaces of a plurality of the resin patterns are covered with the covering film, the film is contacted tightly to the resin pattern by reducing the pressure in the vacuum box, a predetermined amount of particle bodies are filled onto the film in a flask surrounding the film which is in a condition of tightly contacting to the resin pattern, upper portion of the flask is covered with another film, subsequently, the tight contact of the film to the resin pattern is released by returning the reduced pressure being added to the film to normal pressure, inside of the packed particle bodies is evacuated and maintained that condition, the resin pattern is removed from the packed particle bodies under the condition, casting molds having one of mold cavities of the casting product are obtained by removing the resin pattern from the surface of the packed particle bodies, the casting mold is combined with another casting mold having other mold cavity for the product which is manufactured by the same method as above described method, molten metal is poured into the mold cavities of both casting molds, and, after hardened, the casting product is obtained by breaking the packed particle bodies down by returning the pressure in the packed particle bodies in the flask forming the casting mold to normal pressure.

One of other features, the second feature, of the present invention is a method for manufacturing a resin pattern for vacuum sealed molding process wherein one of mold planes of an original pattern is covered with a covering film, the film is contacted with the pattern by suction, a predetermined amount of particle bodies are filled onto the film in a flask surrounding the film which is in a condition of tightly contacting to the pattern, upper portion of the flask is covered with another film, subsequently, the tight contact of the film is released by increasing the reduced pressure being added to the film to normal pressure, inside of the packed particle bodies is evacuated and maintained that condition, the pattern is removed from the packed particle bodies under the condition, the packed particle bodies having a mold cavity obtained by removing the pattern is turned up side down in order to make the mold cavity up side, subsequently, a resin is poured into the mold cavity of the packed particle bodies and is hardened, and a mold having the same shape as the pattern is obtained by break down the packed particle bodies after returning the inside of the packed particle bodies to the normal pressure.

Farther, the second feature includes a method for self hardening molding process using the resin pattern, wherein a plurality of the resin patterns are placed on a plate, a predetermined amount of particle bodies mixed with hardeners are packed up on the resin patterns in a flask surrounding a plurality of the resin patterns and are hardened, subsequently, a mold having a part of mold cavity for the molding product on the surface of its packed particle bodies is obtained by removing the resin patterns, the mold is combined with another mold having another part of the mold cavity for the molding product which is obtained by the same method as the above described method, molten metal is poured into both of the mold cavities, and the casting product is obtained by break down the packed particle bodies forming the casting mold after the metal is hardened.

Additionally, the second feature includes a method for green sand molding process using the resin pattern, wherein a plurality of the resin patterns are placed on a plate, a predetermined amount of particle bodies mixed with a caking agent are packed up on the resin patterns in a flask surrounding a plurality of the resin patterns and are hardened by pressurization, subsequently, a mold having a part of mold cavity for the molding product on the surface of its packed particle bodies is obtained by removing the resin patterns, the mold is combined with another mold having another part of the mold cavity for the molding product which is obtained by the same method as the above described method, molten metal is poured into both of the mold cavities, and the casting product is obtained by break down the packed particle bodies forming the casting mold after the metal is hardened.

In accordance with the present invention, the casting product is manufactured by a vacuum sealed molding process using the resin pattern as above described, and consequently, breakage of films used in the vacuum sealed molding process does not occur because the resin pattern has an integrated structure without any seams and lubricating surfaces, a semi-eternal durability without any secular deterioration (distortion by abrasion, breakage, dehydration, and humidification) is obtained because of the resin pattern, and refabrication of the mold and correcting work for the product by hands become unnecessary because of dimensional stability of the casting products.

Farther, vents are formed in a condition as the resin pattern is fabricated and drilling of the vents by hands is not necessary because through holes (the vents) are fabricated by setting up a predetermined number of double solid bodies composed of cores and covering films whereto in the mold cavity, pouring resin into the mold cavity and hardening the resin, and subsequent removing of the cores in the double solid bodies from the mold cavity.

Moreover, an original of the resin pattern can be duplicated by transfer using the mold, and accordingly, a large number of model can be manufactured precisely and cheaply. Farther, the above described feature of the present invention are applicable not only to fabrication of the casting products by vacuum sealed molding process but also to fabrication of the casting products by self hardening molding process and green sand molding process.

DETAILED DESCRIPTION OF THE EMBODIMENTS

Hereinafter, details of the present invention is explained based on embodiments referring to drawings.

Embodiment 1

An embodiment of the present invention relating to a method for manufacturing resin patterns for casting is indicated in FIGS. 1–11.

Figure 1:
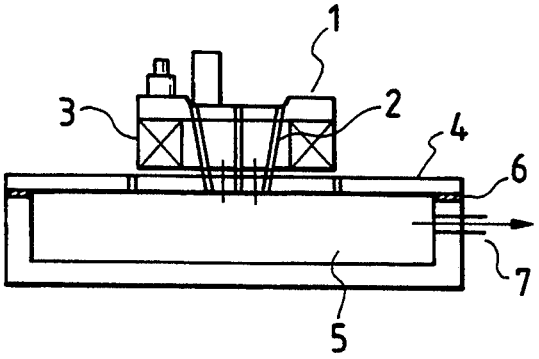
FIG. 1 is a schematic cross section indicating a condition when an original pattern (wooden made) is placed on a vacuum box.
Figure 2:
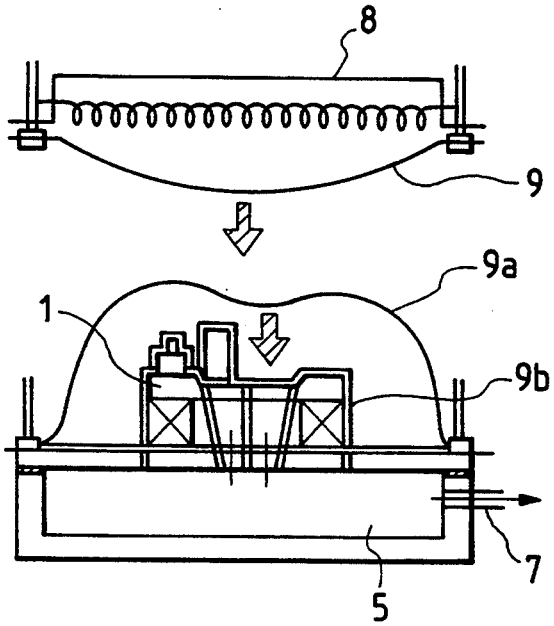
FIG. 2 is a schematic cross section indicating a condition when a covering film is contacted tightly to the original pattern on the vacuum box.

The method for manufacturing resin patterns for casting relating to the embodiment is, as shown in FIG. 1, first, the spacer 3 is inserted to one side of an original pattern (wooden pattern) 1 having almost same shape as an upper half of a final casting product and the vents (through holes) 2, the spacer 3 are fixed to the original pattern fixing plate 4, and the fixing plate is assembled into a vacuum box. The above described spacer 3 is inserted in order to make a lower shape of the original pattern 1. Seams between the original pattern fixing plate 4 and the vacuum box 5 are sealed with the rubber plate 6, and the suction opening 7 which is to be connected with a suction hose connecting to a means for reducing internal pressure (not shown in the figure) is provided to the vacuum box 5. Next, an upper side of the original pattern under the above described condition is hermetically covered with the covering film 9 having the heater 8 as shown in FIG. 2, for instance, ethylene-vinyl acetate copolymer resin film which has preferable wettability and is compatible with resin patterns fabricated in the present embodiment is elongated by heating with the heater 8 and covers the upper side of the original pattern, and internal pressure of the vacuum box 5 is reduced by connecting the suction opening 7 with a suction hose which is connected to a means for reducing pressure (not shown in the figure). Accordingly, the covering film 9 deforms as shown by 9*a*, 9*b* in accordance with suction of air through the vent 2 and tightly contacts to the original pattern 1. Additionally, the covering film 9 varies depending on ambient temperature and heating period of the heater 8 for the original pattern 1 having complex shape, large difference of steps, and deep drawing at dents, and also varies depending on elongating characteristics of the covering film 9. Accordingly, it is important Go select a proper covering film 9 for matching with condition of the original pattern 1.

Figure 3:
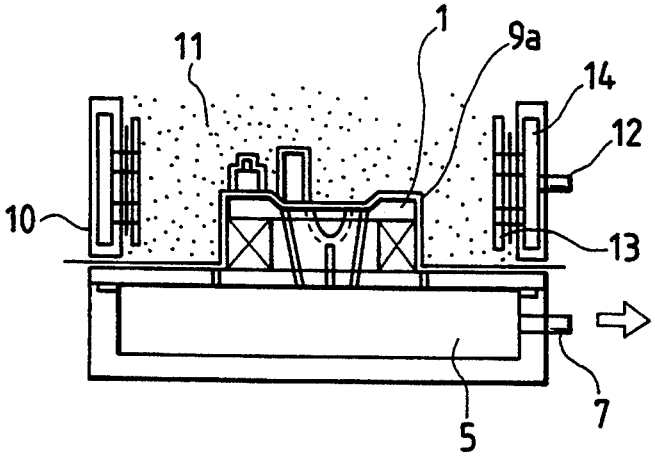
FIG. 3 is a schematic cross section indicating a condition when particle bodies are being packed onto the original pattern which is contacted tightly with the covering film in a flask.
Figure 4:
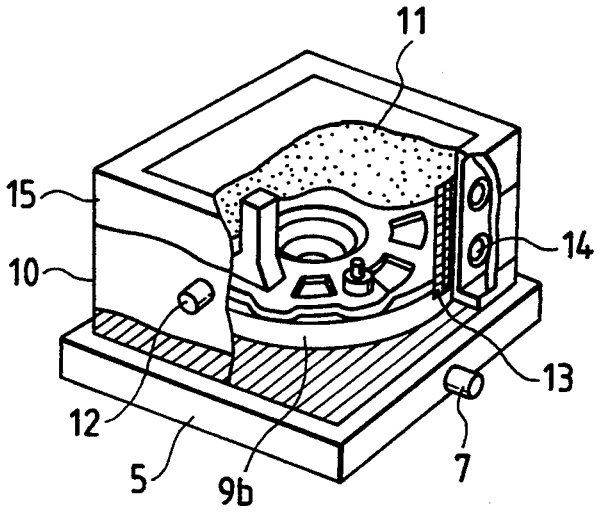
FIG. 4 is a partially cutaway perspective view of FIG. 3.
Figure 5:
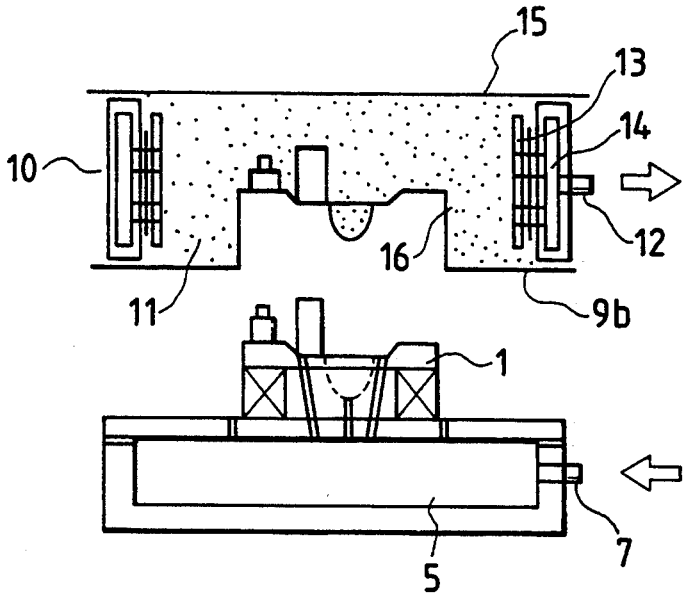
FIG. 5 is a schematic cross section indicating a condition when the original pattern on the vacuum box is being removed from the hardened packed particle bodies.
Figure 6:
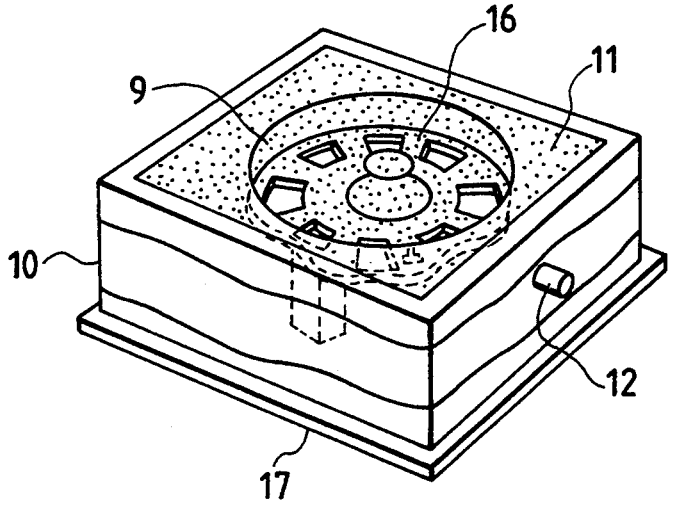
FIG. 6 is a partially cutaway perspective view of a condition when the packed particle bodies shown in FIG. 5 is turned up side down with the flask in keeping reduced pressure and is placed on a plate.

Next, the flask 10 is placed on the covering film 9*b* in a condition that the covering film 9 contacts to the original pattern 1, as shown in FIGS. 3 and 4, and the particle bodies 11 (quartz sand, resin beads, glass beads, and natural sand, etc.) is packed into the flask 10 with vibration. Temperature of curing characteristics of a resin which is poured later is adjusted to about 30 C°, accordingly, it is important to select the particle bodies 11 made from a compatible material with the above condition. Farther, the particle bodies 11 in the flask 10 are packed with vibration in order to pack tightly, but a rammer or a ramming plate may be usable. Moreover, the suction openings 12 which lead to internal of the flask 10 at four sides are furnished to the flask, and the internal vacuum vents 14 are open through the mashes 13 at many places in internal sides of the flask 10 which contact with the particle bodies 11. Then, upper side of the flask 10 is farther covered with other covering film 15, internal pressure of the vacuum box 5 is returned to normal pressure under the above described condition, suction hoses are connected to the suction openings 12, and internal pressure of the packed particle bodies 11 is decreased by suction through the internal vacuum vents 14 until the internal pressure reaches a predetermined negative pressure. Under the above described condition, the packed particle bodies 11 in the flask keeps the hardened state, and subsequently, the original pattern fixed to the vacuum box 5 is removed from the packed particle bodies 11 together with the vacuum box 5. Consequently, the mold cavity 16 of the original pattern 1 is formed on the packed particle bodies 11. Subsequently, the packed particle bodies 11 having the formed mold cavity is turned reversely with the flask 10 with keeping the negative pressure and placed on the level base plate 17 as shown in FIG. 6.

Figure 7:
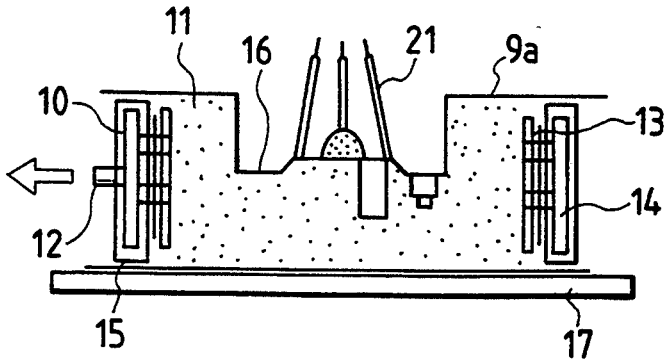
FIG. 7 is a schematic cross section indicating a condition when a double solid body is set up in a mold cavity of the packed particle bodies.
Figure 8:
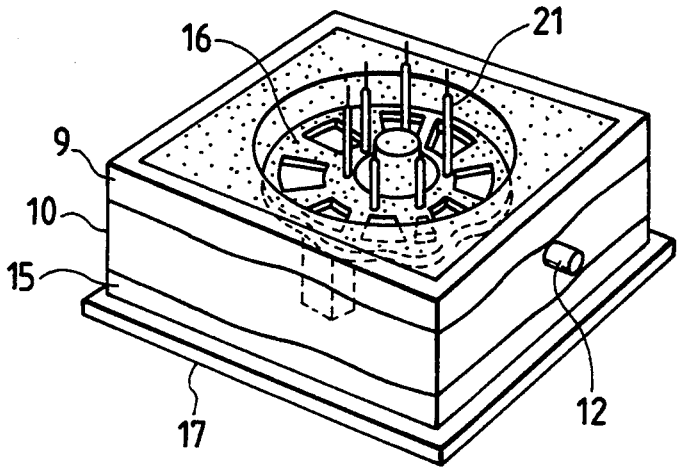
FIG. 8 is a partially cutaway perspective view of FIG. 7.

Next, as shown in FIGS. 7 and 8, necessary portions of the vents 2 in the resin pattern to be obtained are previously determined, and cores and double solid bodies 21 comprising external covers for covering the cores are placed in the mold cavity 16 on the reversed packed particle bodies 11. The double solid body 21 is fixed on bottom of the mold cavity by applying an adhesive agent to a portion of the core which is uncovered by cutting off one side of the external cover in 3–4 mm for exposing the portion of the core and sticking the body 21 to the packed particle bodies through the covering film 9*b* using, for example, a solid wire of 0.9 mm in diameter having polyvinyl coating. The application of the adhesive agent is aimed at preventing penetration of the liquid resin into the internal of the double solid body 21 and fixation of the double solid body 21.

Figure 9:
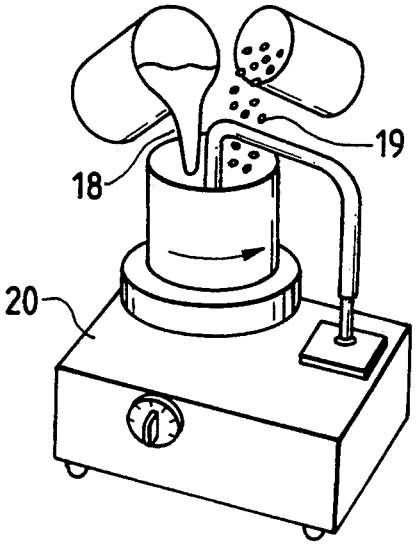
FIG. 9 is a perspective view of a condition wherein a mixture of a resin and a filler is being agitated with a mixer.

Next, a mold resin is poured into the mold cavity 16 on the packed particle bodies 11 under the above described condition. The mold resin is manufactured by mixing with an agitator 20 a resin 18 composed from a main agent (epoxy resin of bisphenol A type), a hardener (modified polyamide amine), and particle state balloons, and the filler 19 such as artificial wood, as shown in FIG. 9. The filler 19 has a lighter specific gravity than the resins, and the artificial wood has more than 1 cm in length. The mixture of the resin 18 and the filler 19 is used after vacuum degassing, if necessary.

And, before pouring the above described mold resin into the mold cavity 16 of the packed particle bodies 11, quick drying silicone resin is applied to the mold cavity 16 and the spacer 3 is inserted to the mold cavity 16 in order to improved release of a mold product from the covering film 9*b*.

Figure 10:
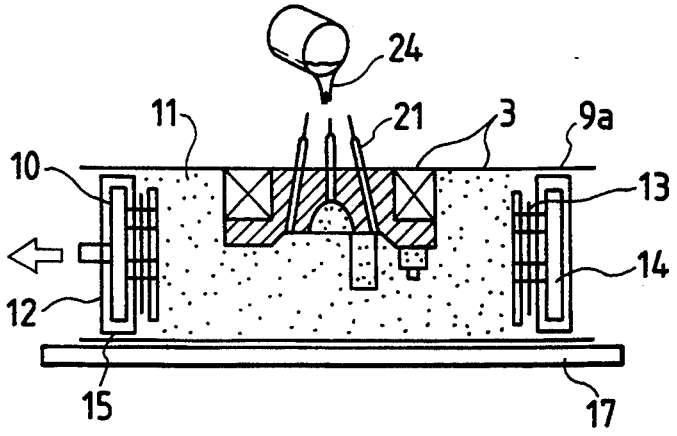
FIG. 10 is a schematic cross section indicating a condition when the mixture of the mold resin obtained by mixing and agitation as shown in FIG. 9 is being poured into the mold cavity for the particle bodies in the condition shown in FIGS. 7 and 8.
Figure 11:
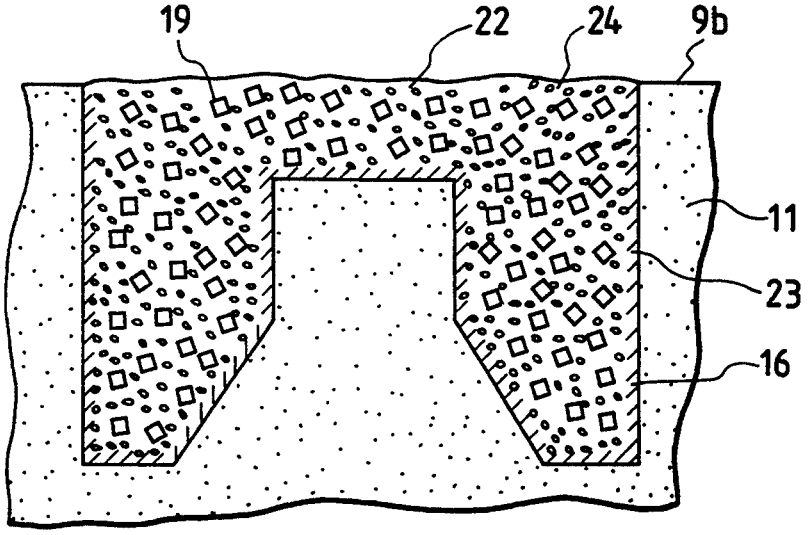
FIG. 11 is a schematic cross section indicating a status in detail of the mold resin poured into the mold cavity in the packed particle bodies.

The spacer 3 having lighter specific gravity than resins such as foamed urethane and foamed styrene etc. is used. The above described resin mixture 24 is poured into the mold cavity 16 under the above described condition as shown in FIG. 10. Although the poured resin mixture 24 is cold setting type, external heating with a portable blower etc. may be usable in order to enhance curing. FIG. 11 indicates a condition after the resin mixture 24 has been poured into the mold cavity 16 on the packed particle bodies 11. As previously described, the resin 18 is composed from the main agent of bisphenol A type epoxy resin, a hardener of modified polyamide amine, and the particle state balloon 22, but as for a liquid resin, the liquid resin mixture 23 of bisphenol A type epoxy resin and modified polyamide amine acts as a surface tension to the covering film 9*b* and forms a stable film thereon, and consequently, the mixture 23 brings bright and smooth surface to the manufactured resin pattern.

Figure 12:
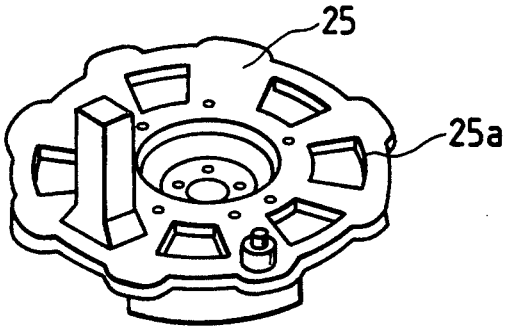
FIG. 12 is a perspective view of a resin pattern fabricated in accordance with an embodiment of the present invention.

After pouring the resin mixture 24 into the mold cavity 16 and hardening the resin mixture 24, the vent 25*a* through the hardened resin pattern is formed by removing the core in the double solid body 21. Subsequently, the packed particle bodies 11 is broken down by stopping suction and returning the reduced pressure in the packed particle bodies 11 to normal pressure, and the resin pattern 25 having the same shape as the shape of the original pattern which has the almost same shape as the upper half of the casting product remains, and the resin pattern 25 having the vent 25*a* is obtained. The resin pattern is shown in FIG. 12. Besides, the broken packed particle bodies 11 is recovered and used again.

Figure 13:
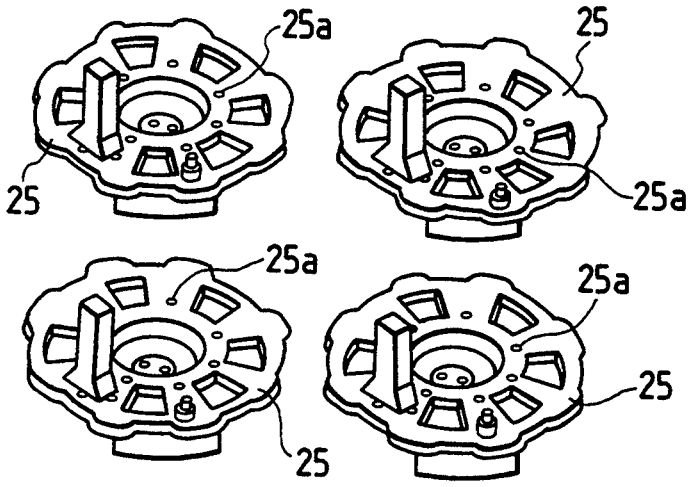
FIG. 13 is a perspective view of four resin patterns fabricated in accordance with an embodiment of the present invention.

In accordance with the above described process, a plurality of the resin patterns 25, for example, four resin patterns as shown in FIG. 13 are manufactured.

Next, a vacuum sealed molding process for manufacturing casting product using the resin pattern having the vents 25*a* is explained referring to FIGS. 14–20.

Figure 14:
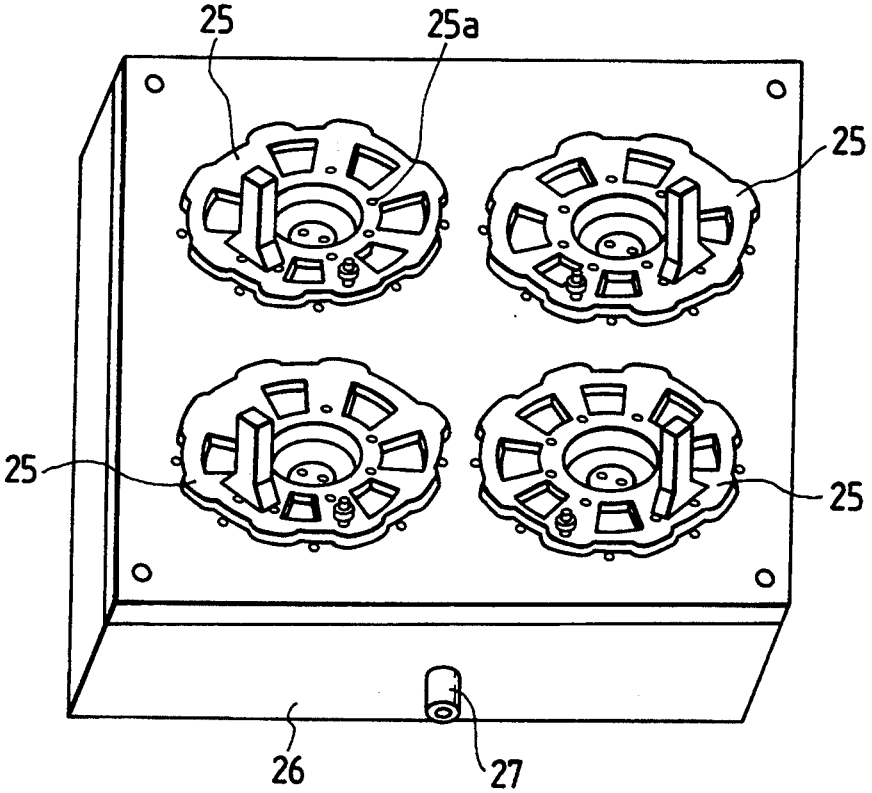
FIG. 14 is a perspective view indicating a condition when the four resin patterns fabricated by the above described method are placed on a vacuum box for vacuum sealed molding process.
Figure 15:
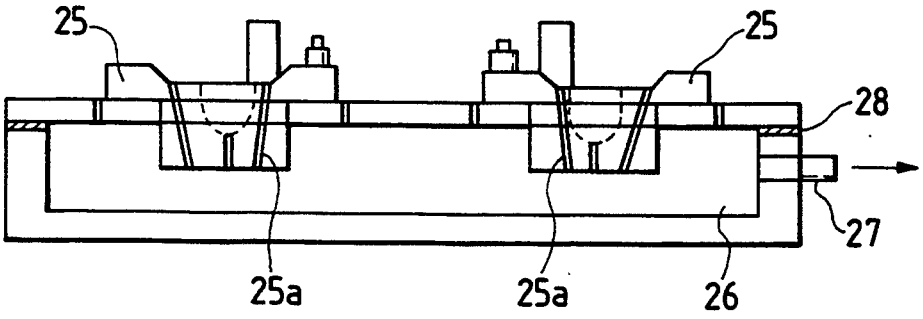
FIG. 15 is a cross section of FIG. 14.

The four resin patterns 25 manufactured by the above described process are fixed on the resin pattern fixing plate 26*a* as shown in FIGS. 14 and 15, and the plate is assembled into the vacuum box for vacuum sealed molding process 26. Seams between the resin pattern fixing plate 26*a* and the vacuum box for vacuum sealed molding process 26 is sealed with the rubber plate 28. On the other hand, the vacuum box for vacuum sealed molding process 26 is furnished with a means for reducing pressure (not shown in the figures) to decrease the internal pressure and the suction opening 27 for connecting the suction hose.

Figure 16:
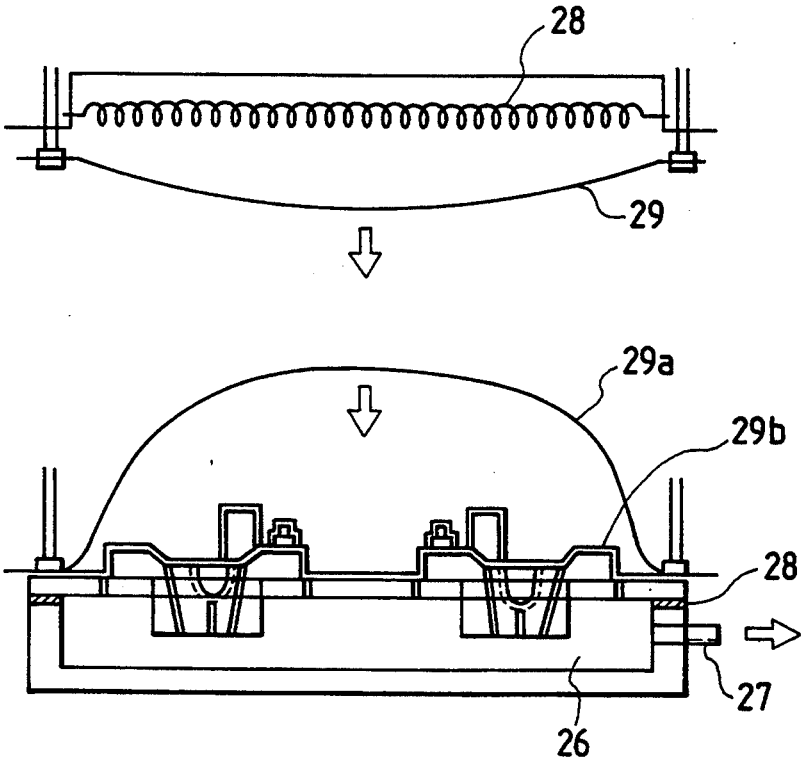
FIG. 16 is a partial cross section indicating a condition when a covering film is tightly contacted to the four resin patterns on the vacuum box for vacuum sealed molding process.
Figure 17:
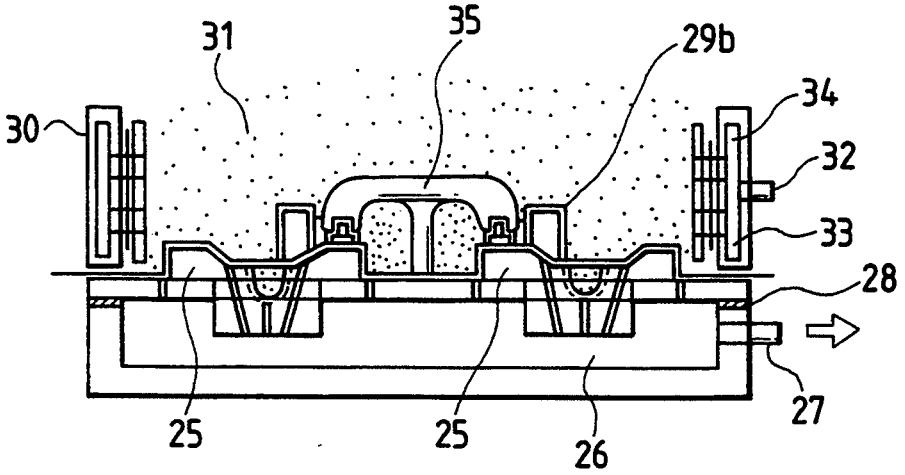
FIG. 17 is a schematic cross section indicating a condition when particle bodies are being packed on the four resin patterns which is tightly covered with the covering film in the flask.

Next, upper surfaces of the four resin patterns under the above described condition are hermetically covered with the film 29 having the heating source (heater) 28 as shown in FIG. 16, for instance, a thin plastic film 29 having a large elongation coefficient and a large plastic deformation rate is heated and elongated by heating with the heater 28, and covers the upper surface of the patterns in a manner so as to wrap the upper surface of the resin patterns in air tight manner. Then, a suction hose which is connected to a means for reducing pressure is connected to the suction opening 27, and internal pressure of the vacuum box for vacuum sealed molding process 26 is reduced. Accordingly, the film 29 is deformed by suction of air through the vent 25*a* of the resin patterns 25 as shown by 29*a* and 29*b*, and tightly contacts to surface of the resin patterns 25.

Figure 36:
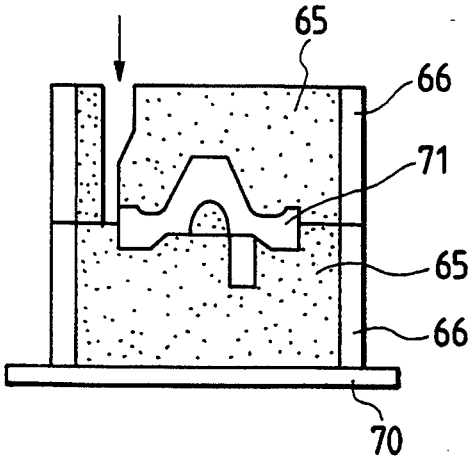
FIG. 36 is a schematic cross section indicating a condition when a cope and a drag in a condition wherein the packed particle bodies are under reduced pressure are engaged together, and molten metal is being poured into a space between the molds.
Figure 37:
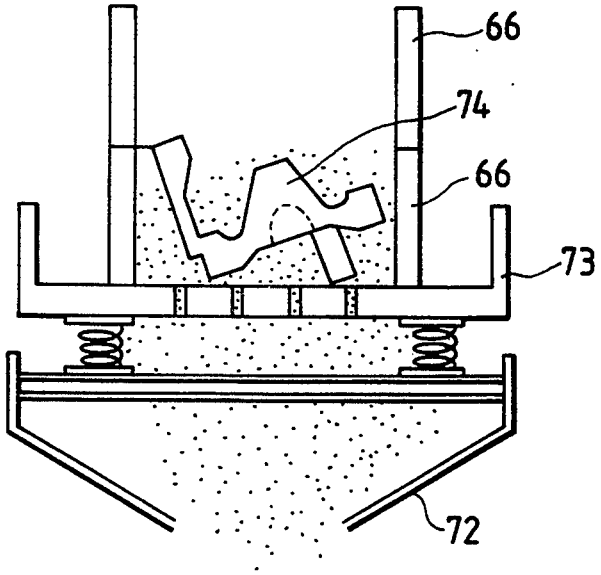
FIG. 37 is a schematic cross section indicating a condition when the packed particle bodies are being broken down by returning the reduced pressure in the packed particle bodies to normal pressure.
Figure 38:
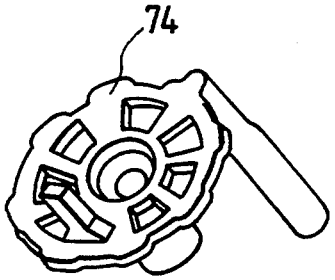
FIG. 38 is a perspective view indicating a casting product fabricated by a method for green sand molding process of an embodiment of the present invention.

Under a condition when the film 29 tightly contacts to the resin patterns 25 as shown by 29*b*, the four resin patterns 25 are connected each other with the sprue pipes 35 which will form passageway for molten metal. Subsequently, the flask 30 is placed on upper surface of the film 29*b* which tightly contacts to the resin patterns 25, and particle bodies (dried sand having adjusted particle size distribution) 31 are packed into the flask 30 with vibration. On the other hand, the flask 30 is furnished with the suction openings 32 through the internal of the flask 30 in four sides, and farther, a plurality of the internal suction vents 34 are furnished at various places in inner wall of the flask 30 which contact with the packed particle bodies 31 placing the mesh 33 between. And, upper portion of the flask 30 is covered with same film 36 as the above described film as shown in FIG. 36, internal reduced pressure of the vacuum box for vacuum sealed molding process 26 under the above described condition is returned to normal pressure, a suction hose is connected to the suction opening 32, and internal pressure of the packed particle bodies 31 in the flask 30 is reduced to a predetermined negative pressure through the internal suction vents 34.

Figure 18:
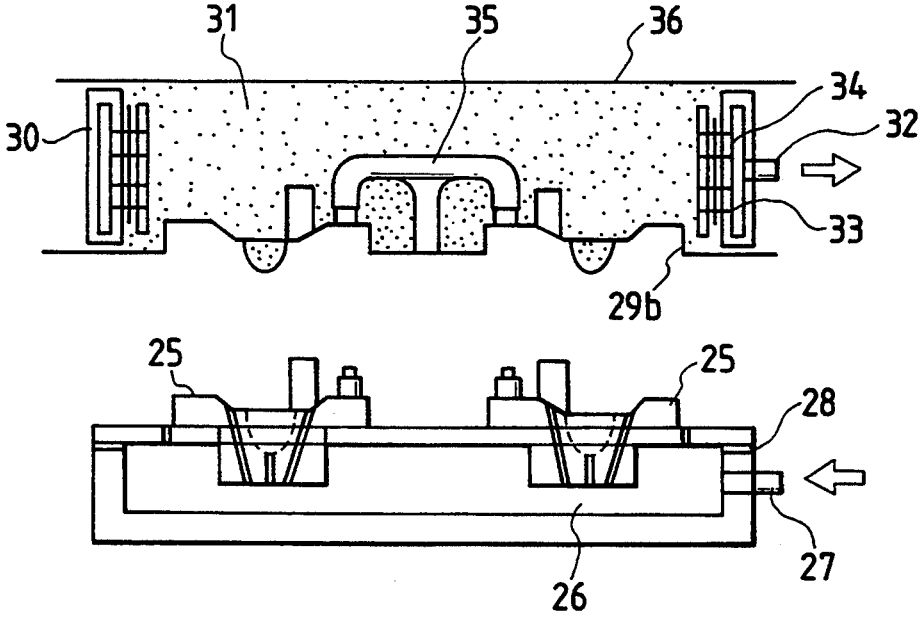
FIG. 18 is a schematic cross section indicating a condition when the four resin patterns on the vacuum box for vacuum sealed molding process are being removed from the hardened packed particle bodies.

In accordance with the above described process, the packed particle bodies 31 in the flask 30 is hardened, then, the resin patterns 25 fixed to the vacuum box for vacuum sealed molding process 26 are removed from the packed particle bodies 31 together with the vacuum box for vacuum sealed molding process 26 as shown in FIG. 18. Consequently, a casting mold having mold cavities formed by the resin patterns 25 on the packed particle bodies 31 is obtained. The obtained mold becomes a drag in manufacturing of casting products.

Next, a resin model having almost same shape as lower half of the casting product, the final product, is manufactured by the same process as shown in FIGS. 1–11, and a casting mold which becomes a cope in manufacturing of the casting products is obtained by the same process as shown in FIGS. 14–20 using the above described resin patterns.

Figure 19:
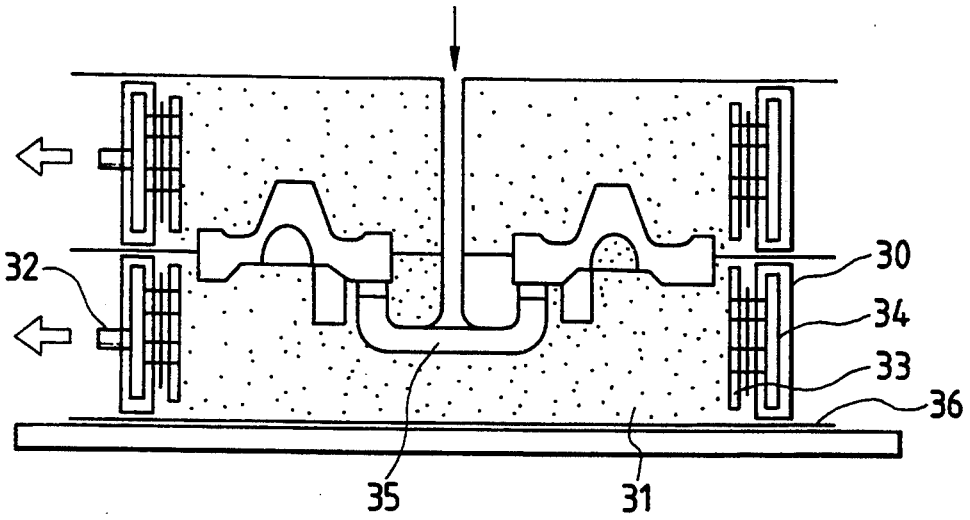
FIG. 19 is a schematic cross section indicating a condition when a cope and a drag in a condition wherein the packed particle bodies are under reduced pressure are engaged together, and molten metal is being poured into a space between the molds.
Figure 20:
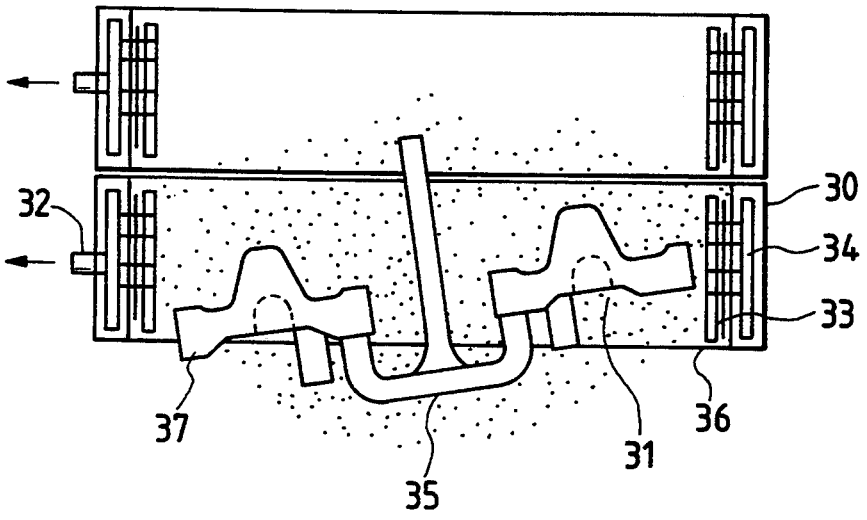
FIG. 20 is a schematic cross section indicating a condition when the packed particle bodies are being broken down by returning the reduced pressure in the packed particle bodies to normal pressure.
Figure 21:
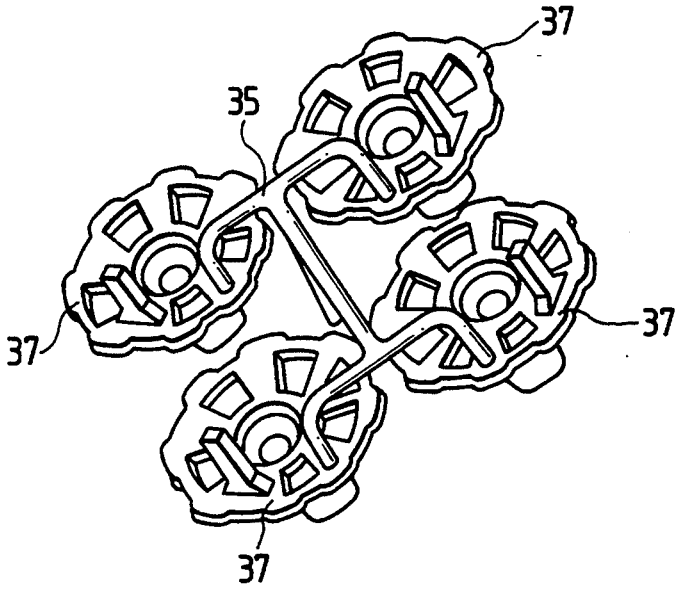
FIG. 21 is a perspective view indicating a casting product fabricated by a method for vacuum sealed molding process of an embodiment of the present invention.

The cope and the drag are combined together as shown in FIG. 19 with maintaining the reduced internal pressure of the packed particle bodies 31 in the flask 30. Then, molten metal is poured into a cavity formed by combining the cope and the drag through the sprue pipe 35. After solidifying the molten metal in the cavity, the packed particle bodies 31 is broken down by returning the reduced internal pressure of the packed particle bodies 31 in the flask 30 as shown in FIG. 20, and the casting product 37, the final product, is obtained. The four casting products finally completed are shown in FIG. 21.

Embodiment 2

Next, referring to FIGS. 22–30, a method for self hardening molding process is explained.

Figure 22:
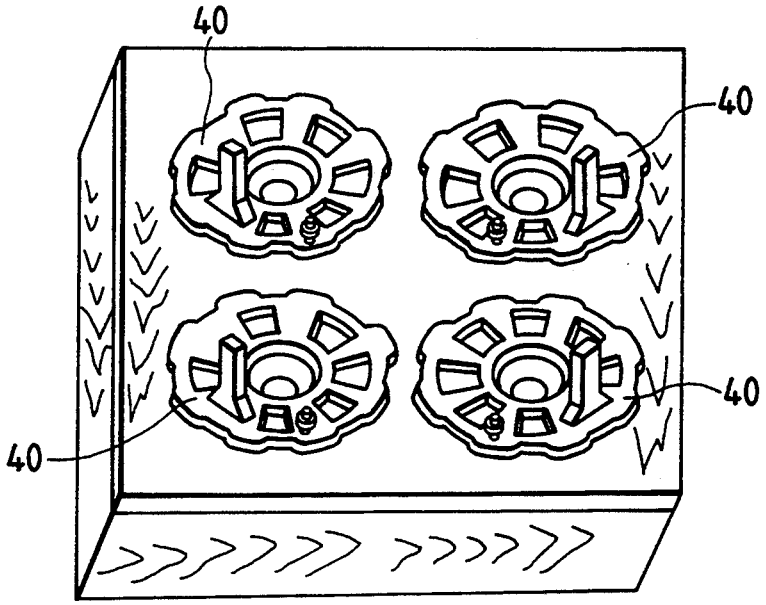
FIG. 22 is a perspective view indicating a condition when the four resin patterns indicated in FIG. 13 are placed on a receiving box for resin patterns.
Figure 23:
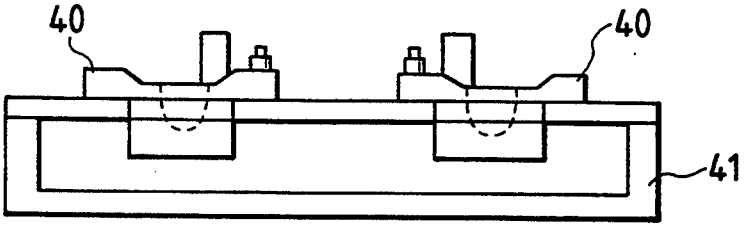
FIG. 23 is a schematic cross section of FIG. 22.
Figure 24:
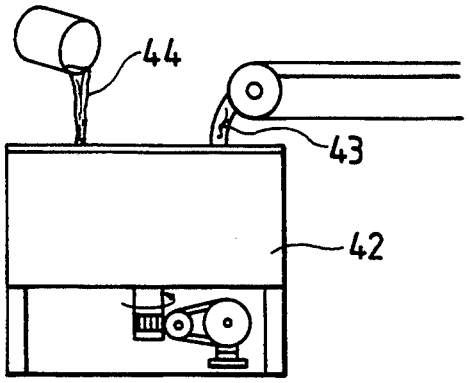
FIG. 24 is a partial cross section indicating a condition when particle bodies are being manufactured by mixing resins and hardeners with a mixer.

First, the resin patterns 40 having the same shape as an upper half of the casting product and being manufactured by the process shown in FIGS. 1–12 (but, as the resin model in the present embodiment is not used for vacuum sealed molding process, the manufacturing process for forming the vent 25*a* using the double solid body 21 as indicated in FIGS. 7 and 8, is not necessary) are placed on the receiving box for four resin patterns as shown in FIGS. 22 and 23. Particle bodies are packed on the resin patterns 40 placed on the receiving box for the resin patterns 41, but as for the particle bodies in the present embodiment, a mixture of sand (for example, quartz sand) 43, and a hardener (for example, water glass, phenol) 44 which are mixed by a mixer 42 is used.

Figure 25:
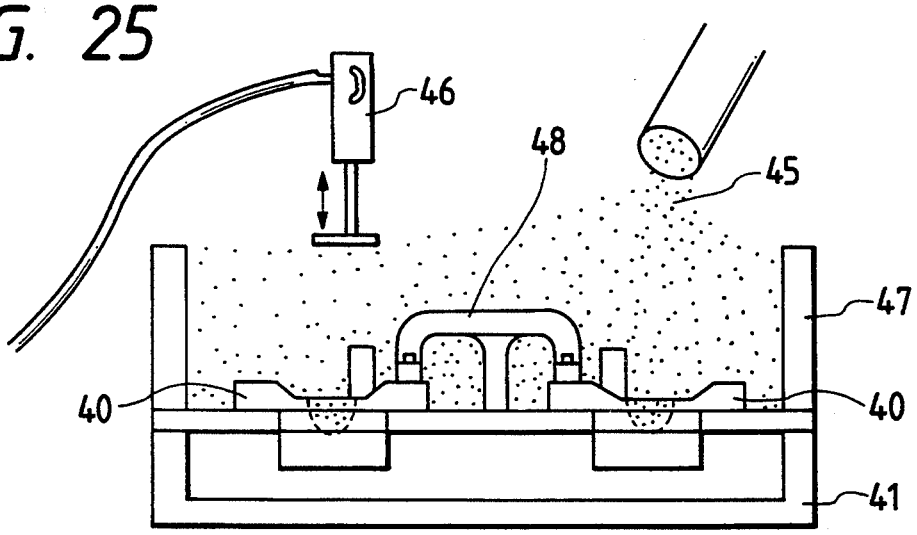
FIG. 25 is a schematic cross section indicating a condition when the particle bodies shown in FIG. 24 are being packed and hardened into a metallic flask on the resin pattern which is placed on the receiving box for resin patterns.
Figure 26:
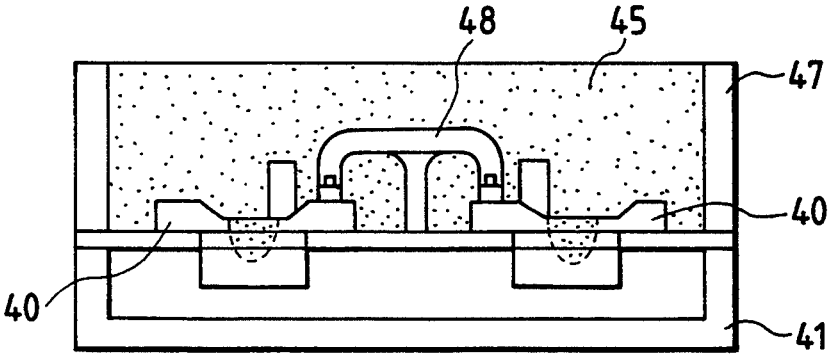
FIG. 26 is a schematic cross section indicating a condition when the packed particle bodies have been hardened.
Figure 27:
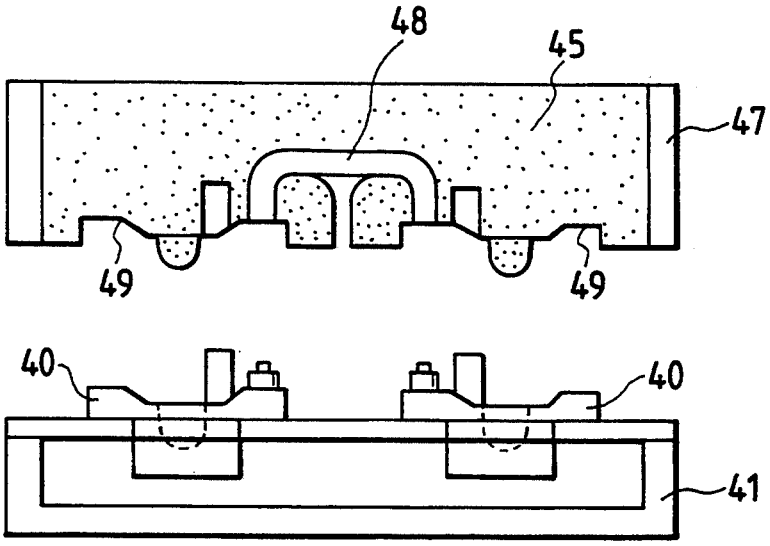
FIG. 27 is a schematic cross section indicating a condition when the four resin patterns on the receiving box for resin patterns are being removed from the hard packed particle bodies.

The particle bodies 45 composed from the sand 43 and the hardener 44 which are mixed by the mixer 42 are packed in the metallic flask 47 on the resin patterns 40 which are placed on the receiving box for the resin patterns 41 as shown in FIG. 25. Besides, the four resin patterns are connected each other by the sprue pipes 48 before packing the particle bodies 45 into the metallic flask 47. After packing the particle bodies 45 into the metallic flask 47 on the resin patterns 40, the packed particle bodies 45 is hardened by beating surface of the packed particle bodies 45 by the pressing machine 46 because of an effect of the hardener 44. The present condition is shown in FIG. 26.

After hardening of the packed particle bodies 45, the resin patterns 40 which are placed on the receiving box for the resin patterns are removed from the packed particle bodies 45. Consequently, the mold cavity 49 having the same shape as the resin patterns 40 is formed on the packed particle bodies 45, and the mold cavity becomes a casting mold, that is, a drag for manufacturing the casting product.

Next, the resin patterns having the same shape as a lower half of the casting product, the final product, are manufactured by the same process as shown in FIGS. 1–11, and the casting mold which becomes a cope can be obtained by the same process as shown in FIGS. 22–27 using the resin patterns.

Figure 28:
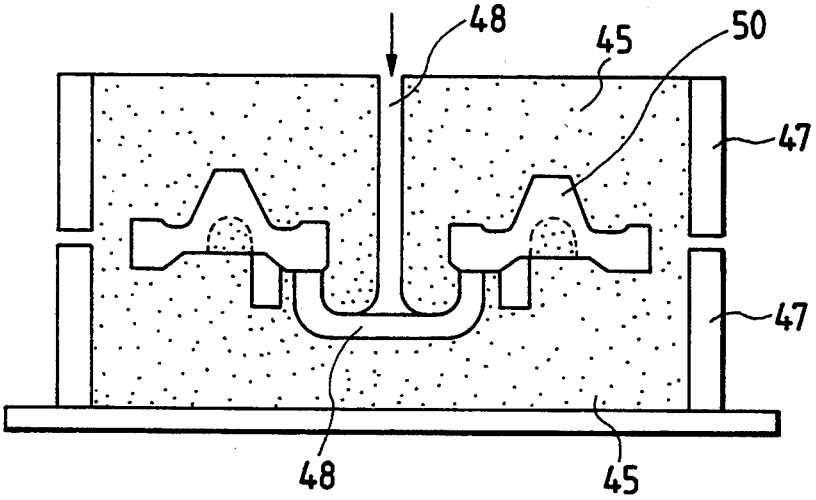
FIG. 28 is a schematic cross section indicating a condition when a cope and a drag in a condition wherein the packed particle bodies are under reduced pressure are engaged together, and molten metal is being poured into a space between the molds.
Figure 29:
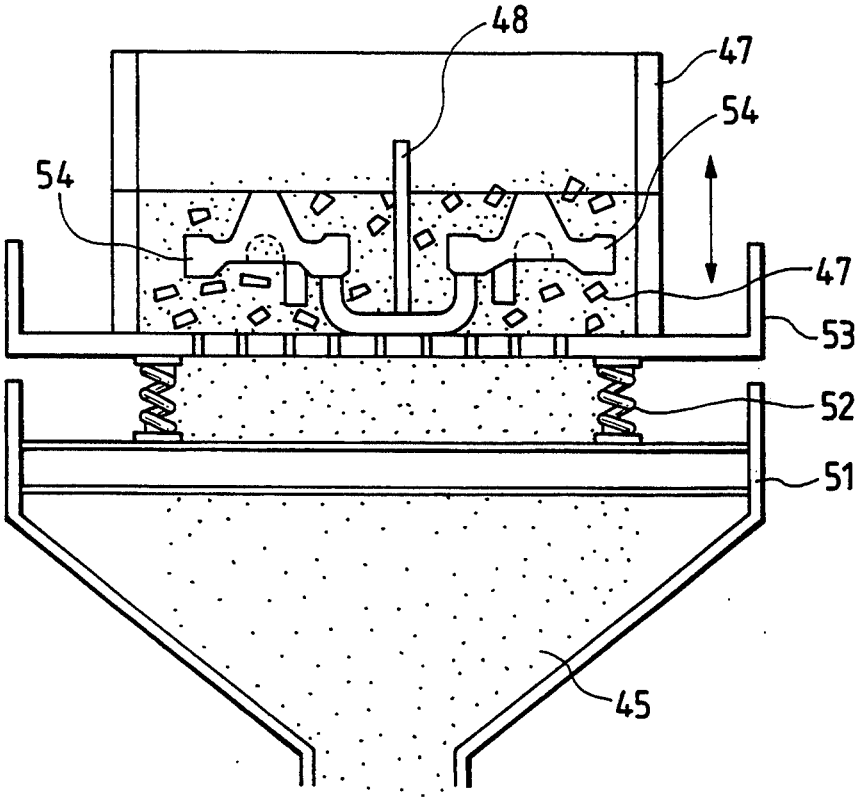
FIG. 29 is a schematic cross section indicating a condition when the packed particle bodies are being broken down by returning the reduced pressure in the packed particle bodies to normal pressure.
Figure 30:
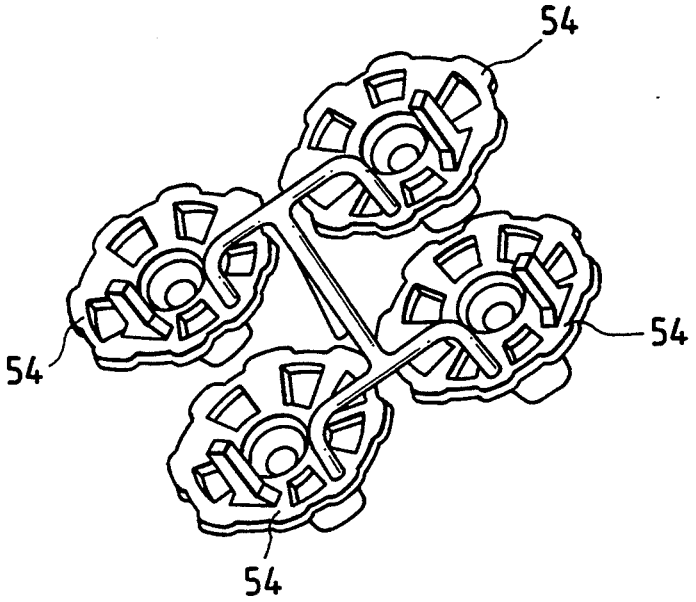
FIG. 30 is a perspective view indicating a casting product fabricated by a method for self hardening molding process of an embodiment of the present invention.

The cope and the drag are combined together as shown in FIG. 28, and molten metal is poured into the cavity 50 formed by the combination of the molds through the sprue pipes 48. Subsequently, after solidifying the molten metal in the cavity 50, the cope and the drag as they are combined together are placed on the metallic flask receiver 53 as shown in FIG. 29, and the metallic flask receiver 53 is vibrated by the casting sand stripper 51 inserting the elastic member 52 (for instance, a spring) between. Consequently, the packed particle bodies 45 in the flask 47 is broken down into the casting sand stripper 51, and the casting products 54, the final products, remain in the flask 47. The four casting products 54 which are finally obtained by the self hardening molding process relating to the present embodiment are shown in FIG. 30.

Embodiment 3

Next, a method for green sand molding process using resin patterns is explained referring to FIGS. 31–37.

Figure 31:
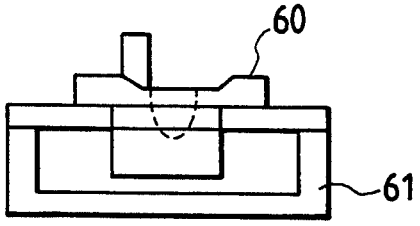
FIG. 31 is a perspective view indicating a condition when the resin pattern indicated in FIG. 12 is placed on a receiving box for resin patterns.
Figure 32:
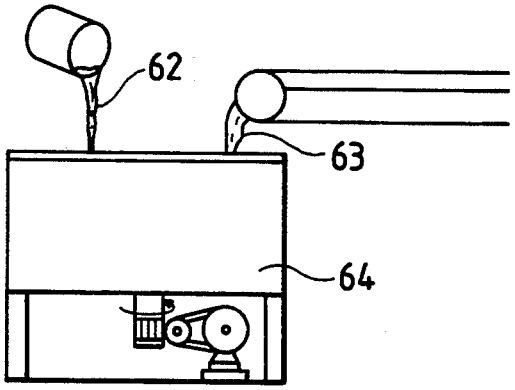
FIG. 32 is a partial cross section indicating a condition when particle bodies are being manufactured by mixing resins and caking agents with a mixer.

First, the resin model 60 having the same shape as an upper half of the casting product and being manufactured by the process shown in FIGS. 1–12 (but, as the resin pattern in the present embodiment is not used for vacuum sealed molding process, the manufacturing process for forming the vent 25*a* using the double solid body 21 as indicated in FIGS. 7 and 8, is not necessary) is placed on the receiving box 61 for green sand molds as shown in FIG. 31. Particle bodies are packed on the resin pattern 60 placed on the receiving box 61 for the green sand molds, but as for the particle bodies in the present embodiment, a mixture of quartz sand 63, and a caking agent (for example, water, honey, clay, and dendrite etc.) 62, which are mixed by a mixer 64 is used.

Figure 33:
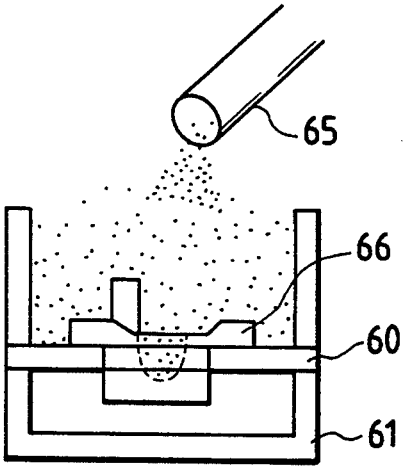
FIG. 33 is a schematic cross section indicating a condition when the particle bodies shown in FIG. 32 are being packed into a metallic flask on the resin pattern which is placed on the receiving box for resin patterns.
Figure 34:
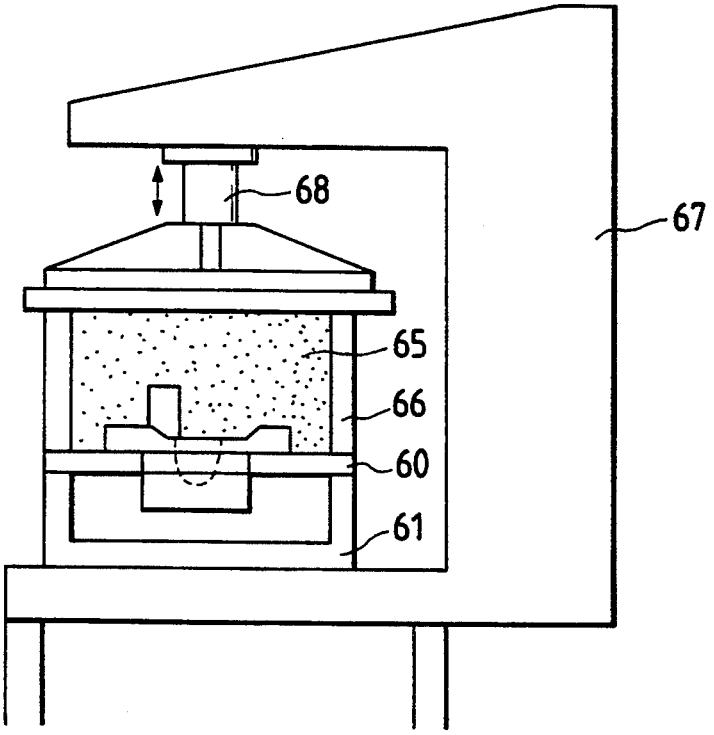
FIG. 34 is a schematic cross section indicating a condition when the packed particle bodies have been hardened by pressurizing with a pressing machine.
Figure 35:
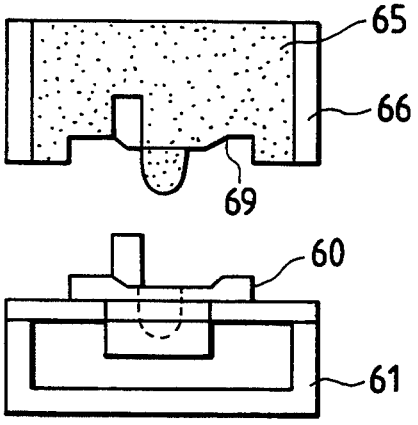
FIG. 35 is a schematic cross section indicating a condition when the resin pattern on the receiving box for resin patterns is being removed from the hard packed particle bodies.

The particle bodies 65 composed from the quartz sand 63 and the caking agent 62 which are mixed by the mixer 64 are packed in the metallic flask 66 on the resin pattern 60 which is placed on the receiving box 61 for the green sand mold as shown in FIG. 33. After packing the particle bodies 65 in the metallic flask 66 on the resin pattern 60, the receiving box 61 for the green sand mold with the metallic flask 66 packed with the particle bodies 65 is placed on the pressing machine 67 as shown in FIG. 34. The particle bodies 65 are pressed and hardened by adding vibration through the cylinder 68 of the pressing machine 67.

After hardening the particle bodies 65, the resin pattern 60 which is placed on the receiving box 61 for the green sand mold is removed from the packed particle bodies 65.

@@ Consequently, the mold cavity 69 having the same shape as the resin pattern 60 is formed on the packed particle bodies 65, and the mold cavity 69 becomes a casting mold, that is, a drag for manufacturing the casting product.

Next, the resin patterns having the same shape as a lower half of the casting product, the final product, are manufactured by the same process as shown in FIGS. 1–11, and the casting mold which becomes a cope can be obtained by the same process as shown in FIGS. 22–27 using the resin pattern.

The cope and the drag are combined together as shown in FIG. 36, and molten metal is poured into the cavity 71 formed by the combination of the molds through the sprue pipe 75. Subsequently, after solidifying the molten metal in the cavity 71, the cope and the drag as they are combined together are placed on the metallic flask receiver 53 as shown in FIG. 29, and the metallic flask receiver 73 is vibrated by the casting sand stripper 72 inserting the elastic member (for instance, a spring) between. Consequently, the packed particle bodies 65 in the flask 66 is broken down into the casting sand stripper 72, and the casting products 74, the final products, remain in the flask 66. The casting product 74 which is finally obtained by the green sand molding process relating to the present embodiment is shown in FIG. 30.

In the above explanation of the method for green sand molding process, the process for producing one casting product, but a plurality of casting products also can be simultaneously manufactured.

Various embodiments of the present invention have previously explained, but in any embodiments of manufacturing casting products by casting methods such as vacuum sealed molding process, self hardening molding process, and green sand molding process using the resin patterns relating to the present invention, breaking of the film does not occur, secular deterioration does not occur even after repeated usages, and economical advantages can be realized.

And, a plurality of resin patterns having preferable qualities can be easily fabricated by making only one original pattern. Farther, as almost of the particle bodies can be recovered, shortened manufacturing period and cost reduction can be achieved. Moreover, the through holes necessary for vacuum sealed molding process, which have been conventionally manufactured by hand works, can be easily fabricated by placing a double solid body composed of a core and a covering film thereon in the casting cavity, pouring and hardening the resin, and subsequently withdrawal of the core.

As for hardening reaction of the resin, the hardening reaction between bisphenol A type epoxy resin and modified polyamide amines is used. Accordingly, when a large volume of the resin is used, thermal deformation can occur. In order to reduce the effect, it is effective to decrease content of the resin component and to make the resin dispersed as possible, and in the present embodiments, mixing of the filler causes the above described effects. The filler has lighter specific gravity than the resin, and consequently, the filler can be homogeneously mixed with the resin and can be hardened like a single phase as if the filler floats in the resin. Accordingly, the light and homogeneous resin pattern having less amount of resin component can be manufactured.

In accordance with the above explained methods relating to the present invention for manufacturing the resin pattern and the vacuum sealed molding process using the resin pattern same, the obtained resin pattern has a seamless integrated structure, breakage of the film which is used in the vacuum sealed molding process can be avoided because of smooth surface of the resin pattern, a semi eternal durability without secular deterioration (distortion by abrasion, breakage, dehydration, and humidification) is realized because of the resin pattern, and refabrication of the casting mold and correcting work by hands on the casting product are not necessitated because of dimensional stability of the casting product. And, machining of the through holes by hand work on the resin pattern is unnecessary because the through holes are simultaneously formed with the fabrication of the resin pattern by the method wherein the through holes are fabricated by placing a double solid body composed of a core and a covering film thereon in the casting cavity, pouring and hardening the resin in the mold cavity, and subsequently withdrawal of the core. Farther, a plurality of the resin patterns can be manufactured precisely and economically by transferring duplication using molds. The above described advantages are same even in the self hardening molding process and the green sand molding process.

What is claimed is:

1. A method for manufacturing a resin pattern for vacuum sealed molding process, which comprises the steps of:

covering a side of molding plane of an original pattern with a covering film, making said covering film contact tightly to the original pattern by vacuum suction of said covering film, packing a predetermined amount of particle bodies onto said covering film in a surrounding flask under a condition that said covering film tightly contacts to the original pattern, covering upper portion of said flask with another covering film, returning said covering film contacting tightly to the original pattern to normal pressure for releasing the tight contact, reducing internal pressure of the packed particle bodies and maintaining the reducing pressure condition, removing the original pattern from said packed particle bodies under the reducing pressure condition, turning said packed particle bodies which forms a mold cavity by removing the original pattern reversely so as to be the mold cavity up side, setting a predetermined number of double solid bodies composed of cores and external covers for covering thereon in the mold cavity, pouring and hardening an amount of resin into the mold cavity in said packed particle bodies, forming a predetermined number of through holes by withdrawing the cores of the double solid bodies, and taking out a resin pattern for vacuum sealed molding process having the same shape as the original pattern by returning the reduced internal pressure of said packed particle bodies to normal pressure for breaking down said packed particle bodies.

* * * * *